US010475329B1

(12) United States Patent
Koester et al.

(10) Patent No.: US 10,475,329 B1
(45) Date of Patent: Nov. 12, 2019

(54) HAND WASHING COMPLIANCE AND MONITORING SYSTEM

(71) Applicant: Tuway American Group, Troy, MI (US)

(72) Inventors: Douglas Koester, Troy, MI (US); Craig Muscott, Troy, MI (US)

(73) Assignee: The Tuway American Group, Inc., Troy, MI (US)

( * ) Notice: Subject to any disclaimer, the term of this patent is extended or adjusted under 35 U.S.C. 154(b) by 0 days.

(21) Appl. No.: 15/613,006

(22) Filed: Jun. 2, 2017

Related U.S. Application Data

(60) Provisional application No. 62/344,568, filed on Jun. 2, 2016.

(51) Int. Cl.
*G08B 21/24* (2006.01)
*A47K 5/06* (2006.01)

(52) U.S. Cl.
CPC ..... *G08B 21/245* (2013.01); *A47K 5/06* (2013.01)

(58) Field of Classification Search
CPC ..... G08B 21/245; G08B 21/24; G08B 21/02; G06F 19/3418; G06F 21/60; A47K 5/06
USPC ..... 340/573.1, 539.11–539.13, 573.4, 529, 340/603
See application file for complete search history.

(56) References Cited

U.S. PATENT DOCUMENTS 5,202,666 A * 4/1993 Knippscheer ..... G08B 7/06 340/541
6,727,818 B1 * 4/2004 Wildman ..... G06F 19/3418 340/573.1
7,375,640 B1 * 5/2008 Plost ..... A47K 5/1217 340/500
9,558,648 B2 1/2017 Douglas
2004/0090333 A1 * 5/2004 Wildman ..... G06F 19/3418 340/573.1
2007/0096930 A1 * 5/2007 Cardoso ..... G08B 21/245 340/573.4
2008/0246599 A1 * 10/2008 Hufton ..... G01S 1/70 340/529
2009/0051545 A1 * 2/2009 Koblasz ..... G08B 21/245 340/573.1
2009/0224907 A1 * 9/2009 Sinha ..... G08B 21/245 340/539.11
2010/0117836 A1 * 5/2010 Seyed Momen ..... G01S 1/70 340/573.1
2010/0164728 A1 * 7/2010 Plost ..... G08B 21/245 340/573.1

(Continued)

*Primary Examiner* — Hoi C Lau
(74) *Attorney, Agent, or Firm* — Young Basile Hanlon & MacFarlane, P.C.

(57) ABSTRACT

A method of hand hygiene compliance enforcement and hand hygiene system comprising at least one dispenser unit that has an interior chamber containing a volume of hand soap or sanitizer and a dispenser nozzle configured to dispense a measured volume of hand soap or sanitizing material upon a triggering event. The dispenser also has a control unit mounted therein, the control unit is in electronic communication with the dispenser nozzle and has at least one identity sensor, at least one alarm indicator and at least one transmitter. The hand hygiene system also has at least one proximity sensor in electronic communication with the control unit. The proximity sensor is located a spaced distance from the at least one dispenser.

9 Claims, 12 Drawing Sheets

(56) References Cited

U.S. PATENT DOCUMENTS

| | | | | |
|---|---|---|---|---|
| 2010/0315244 | A1* | 12/2010 | Tokhtuev | G08B 21/245 340/603 |
| 2011/0227740 | A1* | 9/2011 | Wohltjen | G07C 1/10 340/573.1 |
| 2012/0194338 | A1* | 8/2012 | Snodgrass | G08B 21/245 340/539.12 |
| 2013/0113619 | A1* | 5/2013 | Snodgrass | G08B 21/02 340/539.11 |
| 2013/0127615 | A1* | 5/2013 | Snodgrass | G05B 1/01 340/539.13 |
| 2013/0342349 | A1* | 12/2013 | Cruz | G08B 21/245 340/573.1 |

* cited by examiner

HAND WASHING COMPLIANCE AND MONITORING SYSTEM

RELATED APPLICATIONS

The invention is non-provisional utility application claiming priority to U.S. Provisional Application No. 62/344,568 filed Jun. 2, 2016, the specification of which is incorporated by reference herein.

TECHNICAL FIELD

This disclosure relates to monitoring, reporting, and promoting the use of hand cleaning products and processes, and more particularly, the present disclosure pertains to perimeter-based systems that monitor and record hand-washing compliance within a defined area.

BACKGROUND

Hand care in the workplace effects both work related activities and worker health. Hand hygiene is essential for certain activities and services including, but not limited to, healthcare, food preparation and food service. Hand hygiene is important for virtually all workplaces to maintain a healthy environment and to limit spread of bacteria, viruses and other disease causing micro-organisms. Hand hygiene can be accomplished by washing with soap and water and/or by using liquids such as a waterless sanitizing product. Hygiene products that are used for hand hygiene are commonly dispensed by dispensers that are located where hand hygiene is desired. Hand skin care products can promote worker health in avoiding and treating hand skin conditions that can reduce worker performance and productivity. The invention concerns reporting use of hand care product dispensers for both hand hygiene and hand skin care.

In hospital settings, the spread of healthcare acquired infections known as HAI's is an increasing concern. HAIs can result from transmission of bacteria, viruses and other disease causing micro-organisms from various sources such as a patient or environmental surfaces to another patient or surface via the hands of healthcare workers. A consequence of such transmission can be infection of a patient who was previously not infected. Health care facilities have battled MRSA (methicillin-resistant *Staphylococcus aureus*) and VRSA (vancomycin-resistant *Staphylococcus aureus*) and other drug resistant micro-organisms for many years. These problems have been more apparent in recent years. It is estimated that approximately 2,000,000 such HAIs occur annually in the U.S. alone resulting in about 100,000 deaths. The extra costs associated with these infections are estimated in the billions of dollars.

In the food industry, the proper hand sanitization is necessary to prevent the spread of foodborne bacteria and/or viruses including Norovirus, the Hepatitis A virus, *Salmonella Typhi, Shigella* spp., and *Escherichia coli* (*E. coli*) O157:H7 or other Enterohemorrhagic or Shiga toxin-producing *E. coli, Staphylococcus aureus, Salmonella* spp. and *Streptococcus pyogenes*. Hand washing by food employees is essential after activities that contaminate hands and before activities during which pathogens may be spread to food. One of the activities in the food industry that can lead to food contamination and food borne illness is failure to exercise proper hand hygiene after using the toilet or entering the restroom area.

Food safety agencies, including the FDA have developed recommendations for managing facilities based on Hazard Analysis and Critical Control Point (HACCP) systems. Hand hygiene guidelines have been included in systems that are based on HACCP analysis. HACCP is based on seven principles, one of which is monitoring critical control points. Where hand hygiene is essential, HACCP principles call for monitoring of hand hygiene. As for healthcare hand hygiene guidelines, food related hand hygiene guidelines may be evaluated based on monitoring the number of hand hygiene events at a location within a food facility.

As with any mission-critical activity, it is desirable to be able to monitor compliance and to provide systems to encourage and remind workers about expected behaviors. While various systems have been proposed to remind workers about the necessity of hand washing at certain junctures in their work tasks, heretofore, none have been as successful as desired.

Thus, it would be desirable to provide a system that would promote and remind workers of hand hygiene at specific activity intervals during their workday. It would also be desirable to provide a system that would identify workers as they engage in the desired activity as well as those who are remiss so that good behavior can be rewarded and poorer performance can be corrected. Finally, it would be desirable to provide a system that could record compliance and non-compliance events both for certification and as a tool for continuing or ongoing worker training.

SUMMARY

Disclosed herein is a method of hand hygiene compliance enforcement and hand hygiene system comprising at least one dispenser unit that has an interior chamber containing a volume of hand soap or sanitizer and a dispenser nozzle configured to dispense a measured volume of hand soap or sanitizing material upon a triggering event. The dispenser also has a control unit mounted therein, the control unit is in electronic communication with the dispenser nozzle and has at least one identity sensor, at least one alarm indicator and at least one transmitter. The hand hygiene system also has at least one proximity sensor in electronic communication with the control unit. The proximity sensor is located a spaced distance from the at least one dispenser.

These and other aspects of the present disclosure are disclosed in the following detailed description of the embodiments, the appended claims and the accompanying figures.

BRIEF DESCRIPTION OF THE DRAWING

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity. Included in the drawings are the following figures.

DETAILED DESCRIPTION

Disclosed herein is a method for monitoring and promoting hand hygiene in a variety of employment settings. As broadly outlined, the method includes the steps of detecting a target individual such as a worker suitably equipped with a worker identification device as the target individual crossed a perimeter into a physical detection zone. The physical detection zone can be a room or other location equipped with at least one hand sanitation station that includes a sink, a hand sanitation dispenser, and a monitoring system. The method also includes the step of, determining that the hand sanitation dispenser in the system has been activated while the target worked is proximate to the dispenser within a predetermined detection interval after the target individual has crossed into the physical detection zone.

The hand sanitation device and monitoring system as disclosed herein includes at least one sensor array configured to define a detection zone perimeter and detect movement of at least one target individual into the detection zone. The hand sanitation device and monitoring system also includes at least one identity device associated with the target individual and at least one hand sanitation material dispenser that is associated with a hand sanitation station having at least one sink. The hand sanitation material dispenser has at least one monitoring array in communication with the at least one sensor array and optional communication with at least one device external to the detection zone perimeter.

Figure 1:
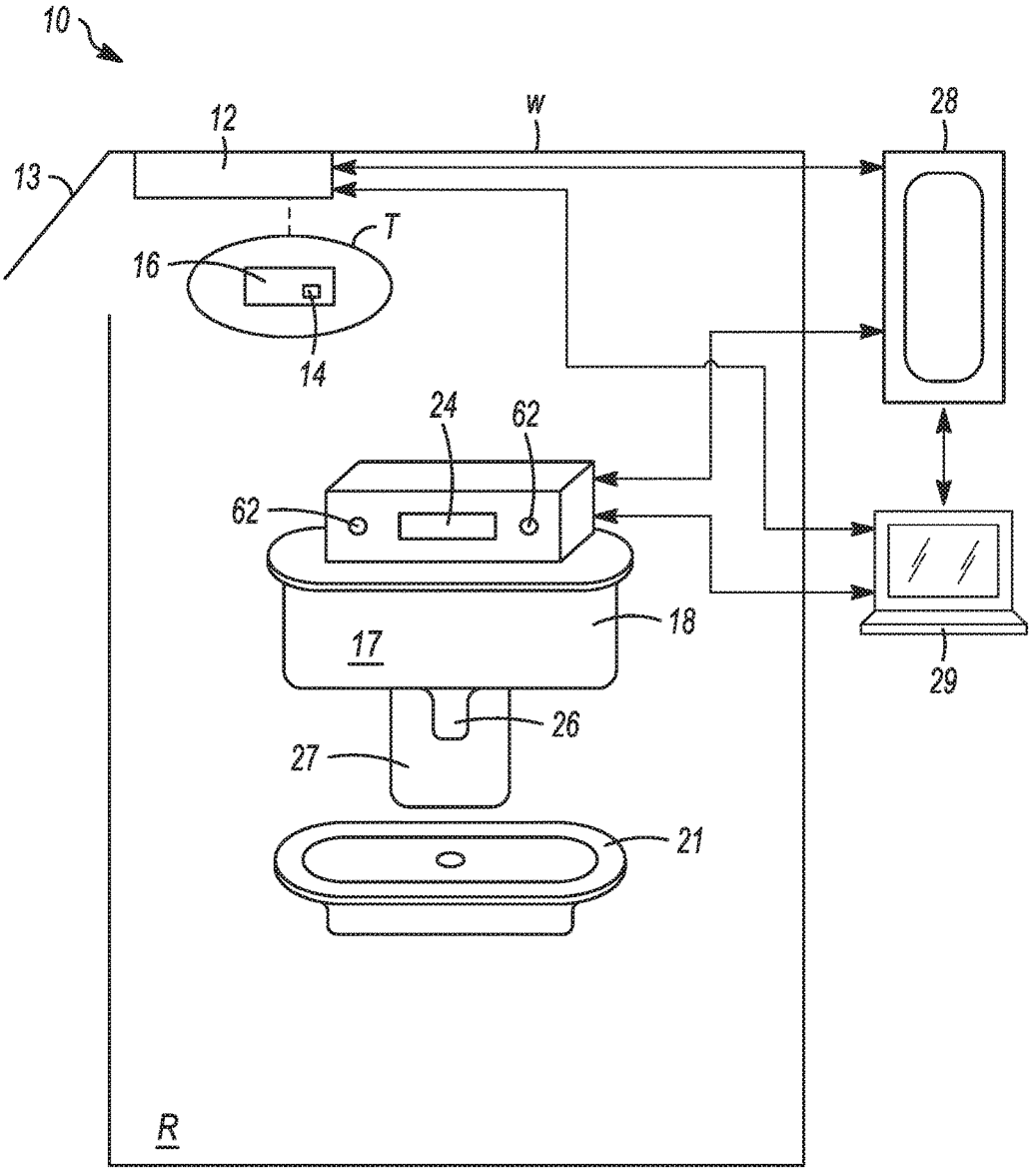
FIG. 1 is a schematic view of a hand sanitization and monitoring system according to an embodiment as disclosed herein.
Figure 2:
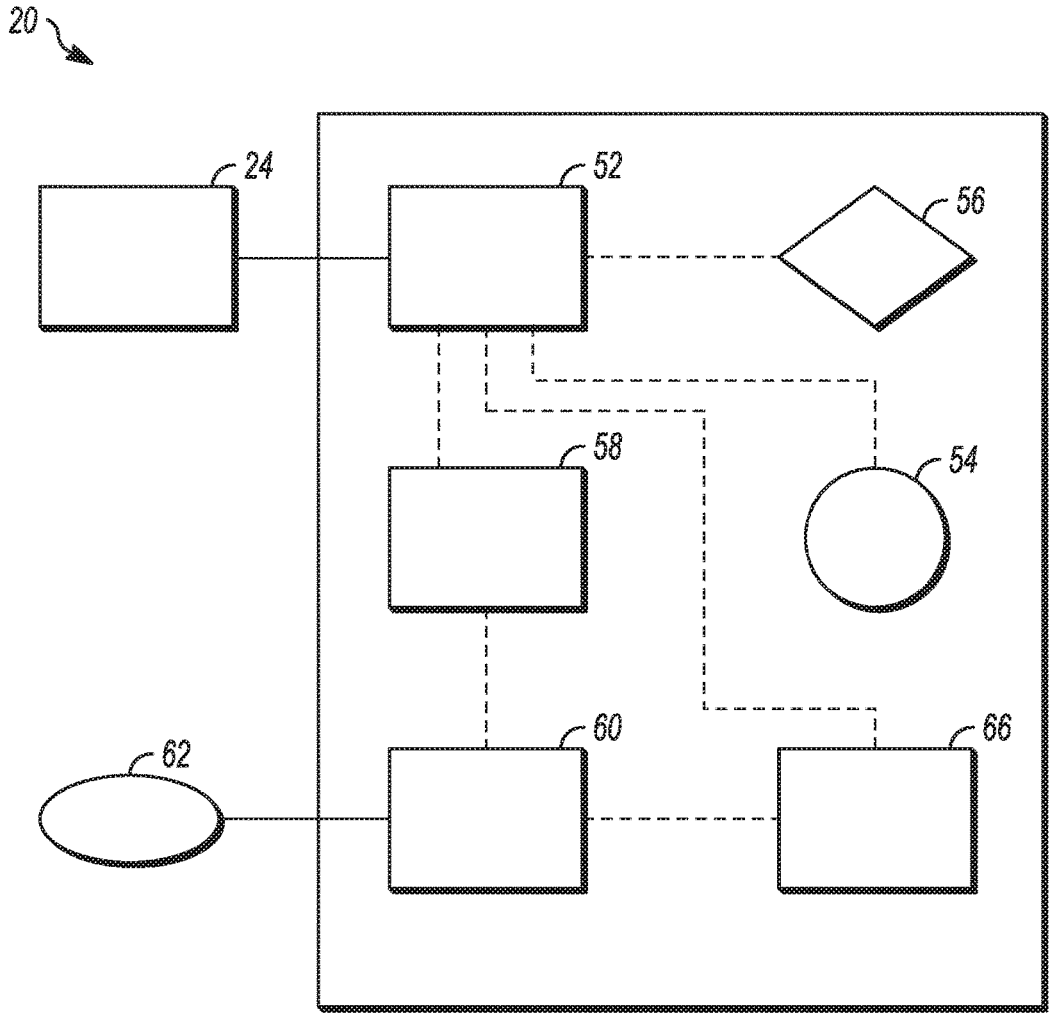
FIG. 2 is a schematic diagram of a controller unit according to an embodiment as disclosed herein.

In one embodiment of the hand sanitation and monitoring system as disclosed and depicted in FIGS. 1, 2 and 3, at least one sensor array 12 is configured to be mounted to a suitable structural member in order to define a detection zone and identify and detect movement of at least one target individual proceeding into or leaving the defined detection zone. In certain embodiments, the detection zone will be a room R or other architectural space having one or more temporary or permanent wall structures W or boundary demarcations. In such situations, the sensor array 12 can be operatively positioned to detect movement of the target individual T into or out of the room R. Where the room R has a defined entryway such as entryway 13, the sensor array 12 can be mounted adjacent to the entryway 13 in order to monitor ingress and egress pertaining to the room R. Where desired or required, one or more sensor arrays can be employed.

It is contemplated that the sensor array and or associated system can be configured to detect movement in an x-axis transiting the entryway 13 while disregarding movement of one or more target individuals that do not transit the entryway such as those that move parallel to the doorway as in the Y-axis.

The at least one sensor array 12 is configured to detect the presence of a compatibly configured identity device 14 that located in an employer-issued identity card 16 and carried by the target individual. The identity card 16 can be configured with any suitable identity device 14, for example a suitable RFID readable chip or the like. The identity card 16 can be configured to be worn in a visible manner as on a lanyard or the like and can include other features and functionalities as desired or required. Non-limiting examples of other functionalities can swipe card entry and the like. The at least one sensor array 12 can be equipped with detection mechanism(s) such as suitably configured RFID readers. Where desired or required, the at least one sensor array can be configured with direction sensing devices configured to ascertain whether the target individual T is entering into the defined perimeter or exiting from the space. However, the method and device disclosed herein are not necessarily limited to such configurations detecting ingress and egress.

The hand sanitation and monitoring system 10 also includes a suitably configured hand hygiene material dispenser 18 that is located within the perimeter monitored by the sensor array 12. The hand hygiene material dispenser 18 is composed of a chamber 17 that is configured to contain a volume of a suitable cleaning material that can be dispensed in measured dose volumes. It is contemplated that the cleaning material will be a suitable soap or detergent that can be used with water to effect suitable hand cleanliness. The chamber 17 can be refillable and can be configured with a suitable refilling aperture (not shown).

The hand sanitation and monitoring system 10 is associated with and is in electronic communication with a hand hygiene dispenser controller 20. In the embodiment depicted in FIG. 1, the hand hygiene controller 20 is mounted on the dispenser chamber 17. In some embodiments, the hand hygiene dispenser controller 20 can be in electronic communication with two or more hand hygiene dispensers 18. In such applications, it is contemplated that the controller 20 can be mounted separately or can be located on one dispenser 18 which serves as the master controller.

In the system disclosed herein, the hand hygiene dispenser 18 can be placed proximate to a source of running water such as a sink 21 that is located within the associated room R. It is contemplated that the hand hygiene dispenser controller 20 can be incorporated in the individual hand hygiene dispenser 18 as depicted the non-limiting embodiment in FIG. 1. It is also considered with in the purview of this disclosure that the hand hygiene dispenser controller 20 can be located a position remote to the dispenser in certain applications.

The hand hygiene dispenser controller 20 can include central processing unit and a timing unit as well suitable data storage and transmission mechanisms. In embodiments where a single hand hygiene dispenser 18 is employed, the hand hygiene dispenser controller 20 can be integrated into the hand hygiene dispenser 18. In embodiments where more than one hand hygiene dispenser 18 is present in room R, the hand hygiene dispenser controller 20 can be incorporated into one of the units or can be present as a stand-alone unit in electronic communication with the various individual hand hygiene dispensers.

A non-limiting embodiment of the hand hygiene dispenser controller 20 is schematically depicted in FIG. 2. The hand hygiene dispenser controller 20, can include a suitable central processing unit (CPU) 52 that is operatively connected to a suitable receiver 54 and transmitter 56. The receiver 54 and transmitter 56 can be configured to facilitate wireless transmission and reception. The central processing unit 52 can include or be operatively connected to a timer 58 that can be linked to the control of an alarm 60 as well other devices and functionalities (not shown). The alarm 60 can be operatively linked to one or more audible and/or visible devices 62, such as LED lights, speakers and the like. In certain embodiments, the audible and/or visible device(s) 62 can be located on or proximate to the hand hygiene dispenser 18. The audible and/or visible device(s) 62 can emit as a series of chirps, light flashes or the like in order to direct the attention of target worker T to one or more hand hygiene dispenser(s) 18 and remind the target worker T of the need to engage in hand hygiene activities to be completed upon room entry or prior to room exit.

The hand hygiene dispenser controller 20 can also include or be linked to at least one suitable hand hygiene dispenser sensor 24. In certain embodiments, the hand hygiene dispenser sensor 24 is configured as a proximity sensor and identity reader. The hand hygiene dispenser sensor 24 is configured to determine the presence of a previously identified target worker T. In the device as disclosed herein, the dispenser sensor 24 determines the proximity of the identity card 16 of the target worker T by located and interrogating the data associated with identity device 14. Information previously detected by sensor array 12 can by conveyed to hand hygiene dispenser controller 20 where it can be stored and compared to information received from sensor 24 to determine correspondence. It is contemplated that the information collected from the sensor array 12 can be conveyed by any suitable means, for example via wired or wireless transmission. The various elements can be operatively linked to a suitable processing unit, such as CPU 52 that is associated with a suitable digital receiver such as receiver 54.

In certain embodiments, the warning alarm can be positioned in the hand hygiene dispenser 18 in the hand sanitation and monitoring system 10 hand hygiene dispenser in a manner that will catch the attention of the target worker T and alert him or her to the need to engage in the appropriate hand hygiene protocol. The warning alarm can be a visible signal, an audible signal or a combination of the two emanating from the hand hygiene unit 18 so as to draw attention of the target worker T to the hand hygiene dispenser unit 18.

The hand hygiene unit 18 can have a suitable proximity sensor 24 that is integrated in the hand hygiene dispenser unit 18. The proximity sensor 24 in electronic communication with the controller 20, 120. The proximity sensor 24 can be configured to identify the ID device 16 associated with the target worker T and convey data to the associated CPU 52 where the CPU 52 can query the collected data to determine whether the perceived ID device 16 has been recently identified by the perimeter sensor array 12.

The CPU 52 contains suitable program logic to compare correspondence between ID devices 16 read that are proximate to proximity sensor 24 with those detected by sensor array 12. If the ID device 16 detected by the proximity sensor 24 associated with the hand hygiene device 18 corresponds to the ID device 16 detected by the sensor array 12 any activation of the warning alarm 62 can be cancelled. The suitable timer 58 is configured to measure and record actual time and/or elapsed time between detection of the target worker T by sensor array 12 and detection of target worker T by sensor 24 and/or actuation of the trigger 27 and/or nozzle 26.

In order to assure that the ID device 16 detected by proximity sensor 24 actually uses the dispenser 18, the dispenser 18 can be configured such that dispenser nozzle 26 and/or trigger mechanism 27 is connected to a detector or sensor (not shown) that is configured to generate at least one command signal that can act on the controller 20 and alarm 62 to discontinue alarm operation. The sensor associated with the trigger 27 and/or nozzle 26 produces a signal that is conveyed to the controller 20 indicting that a measure volume of soap material has been dispensed from the dispenser 18. This operates to discontinue alarm operation. It can also trigger a transmission of a compliance message to at least one externally located device such as device 28. The externally located device 28 can be any suitable device such as a data recorder (not shown), cell phone 28, or computer device 29 for further processing and the like.

Triggering of dispenser nozzle 26 is taken to mean that a portion of the hand soap or cleaning agent present in the dispenser 18 has been dispensed and the worker has engaged in the employer mandated hand washing protocol. Thus, receipt of affirmative messages by CPU 52 is construed as compliance. Transmission data can include components that include but are not limited to one or more of the following: completion of the affirmative action, identification of the associated target worker T, location of the monitoring system 10, date and time of the recorded specific compliance event.

Failure to observe and execute the employer-mandated handwashing protocol can also be addressed by the handwashing compliance system 10 as disclosed herein. In operation, the detection of entry of the target worker T into the room R as detected by sensor array 12 can initiate or trigger the internal timer device present in the controller 20 to measure a predetermined time interval. At the expiration of this time interval, the controller and associated CPU produces a signal that triggers operation of the alarm 62. If the target worker T approaches the dispenser 18 and actuates the trigger 27 and nozzle 26, the operation of the timer is discontinued upon receipt of appropriate compliance messages, namely the detection of the ID chip 16 of the target worker T and triggering of the dispenser by actuation of the trigger mechanism 27 and/or nozzle 26. Delay in detection by the proximity sensor 24 and triggering the trigger 27 and/or nozzle 26 past the pre-programmed timer interval results in actuation of the alarm 62 to remind the target worker T of the desired action.

Disregard of the alarm 62 by the target worker T is considered indicative of non-compliance with the desired employer-mandated handwashing protocol. In the event that the target worker T does not approach the hand hygiene dispensing unit 18 and his ID 16 is not detected by the dispenser mounted proximity sensor 24, the controller 20, transmits a non-compliance message signal to at least one externally located receiver 28, 29. Alternately, or in addition to this non-compliance event message, if the target worker T passes through the sensor array 12 located at the perimeter of the room R without first being detected by the dispenser mounted proximity sensor 24 present on the dispenser unit 18 together with triggering the dispenser nozzle 26, a non-compliance message can be generated as at reference for transmission to the external device 28, 29.

The non-compliance message can be transmitted in any suitable manner as by wireless communication networks to an externally located receiver 28 for further processing, analysis. Non-limiting examples of externally located receivers include one or more suitably configured cell phones 28, computers 29, externally located processing units, etc.

Transmission can be in real time or can be batched depending on the requirements of the given installation. Where real time transmission is employed, it is envisioned that the transmission can be in the form of non-compliance alerts. Where batched transmission is employed, it is envisioned that the transmission can be in the form of compliance reports. Non-limiting examples of such reports will be discussed subsequently. It is also contemplated that transmission can be a combination of real-time and batched reports. It is also considered to be within the purview of this disclosure that transmission of a given message can include one or more commands actionable on one or more devices remote to the room being monitored.

Figure 3A:
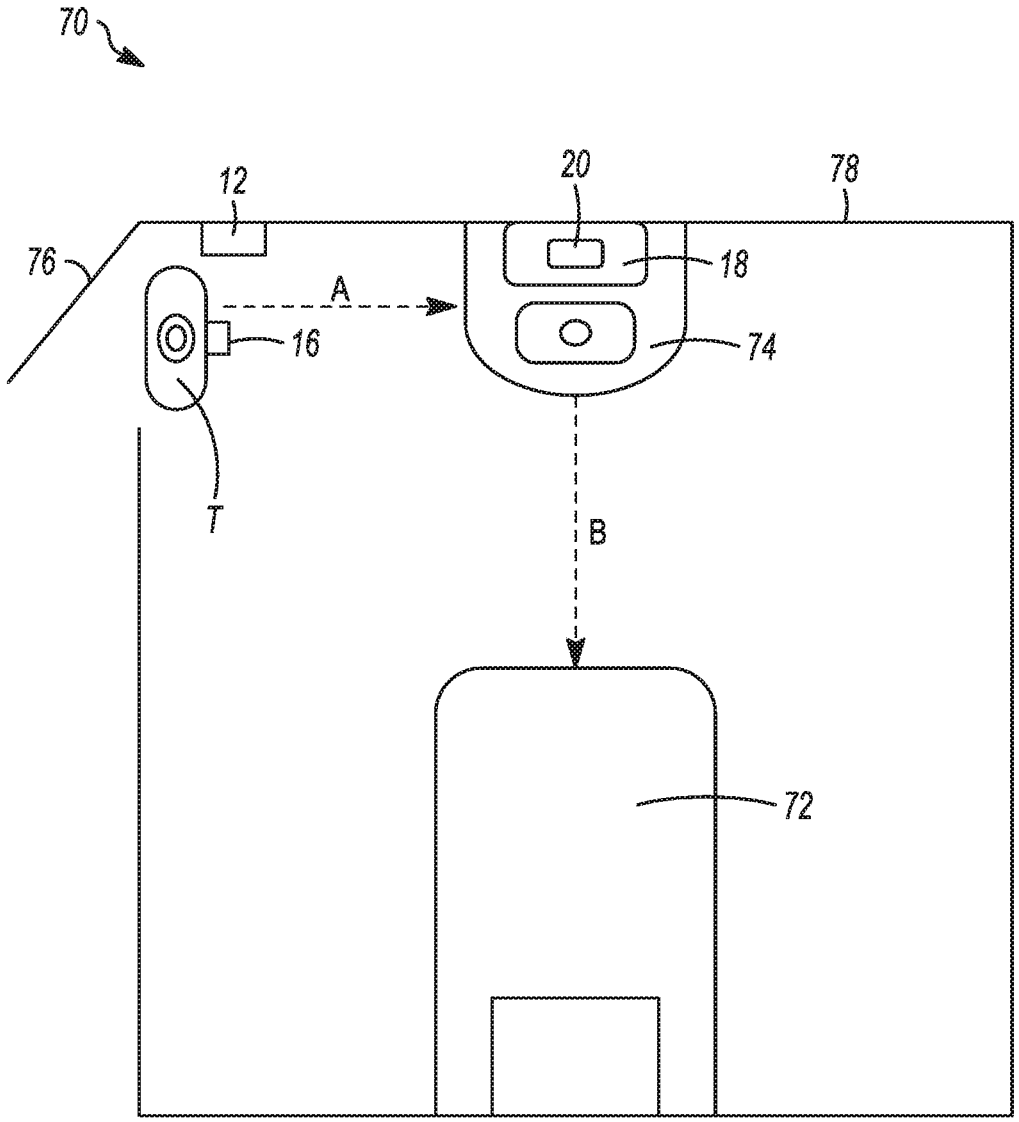
FIG. 3A is a schematic room diagram including the embodiment of FIG. 1.
Figure 3B:
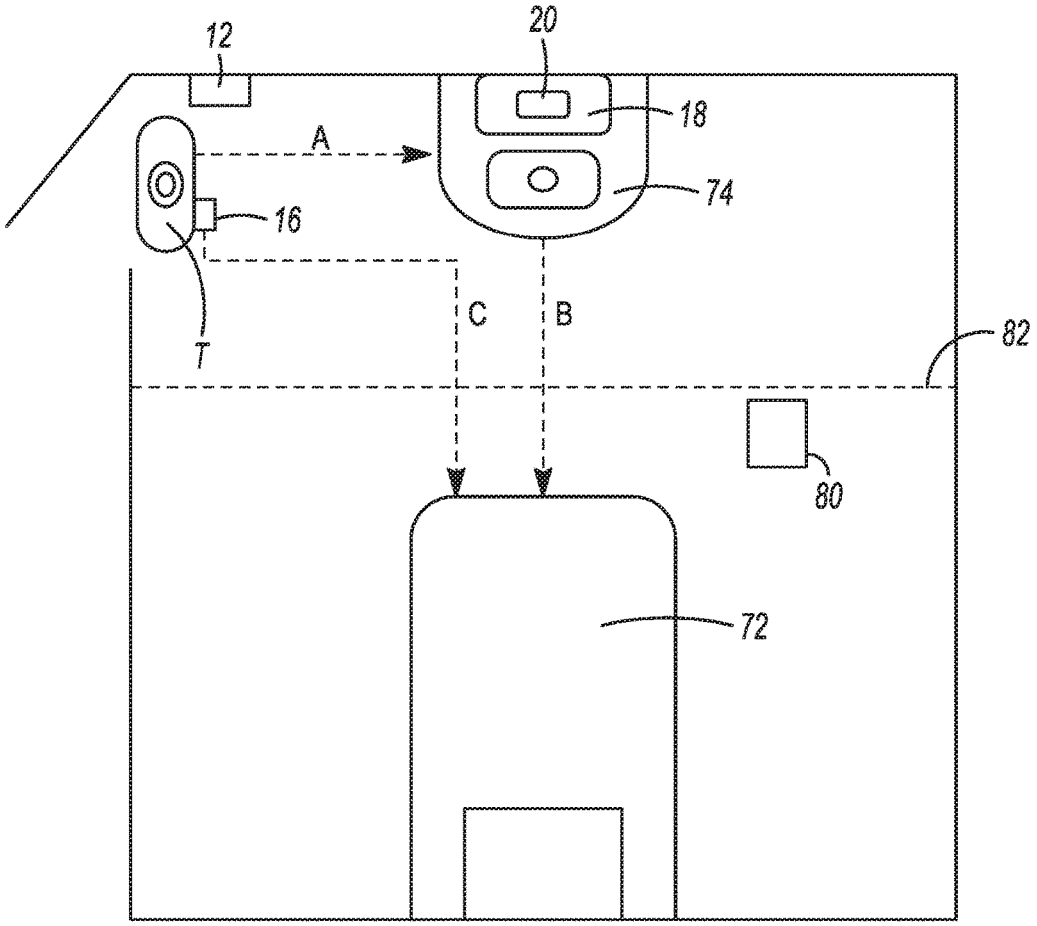
FIG. 3B is a schematic room diagram of FIG. 3A including interior boundary sensor device.
Figure 4:
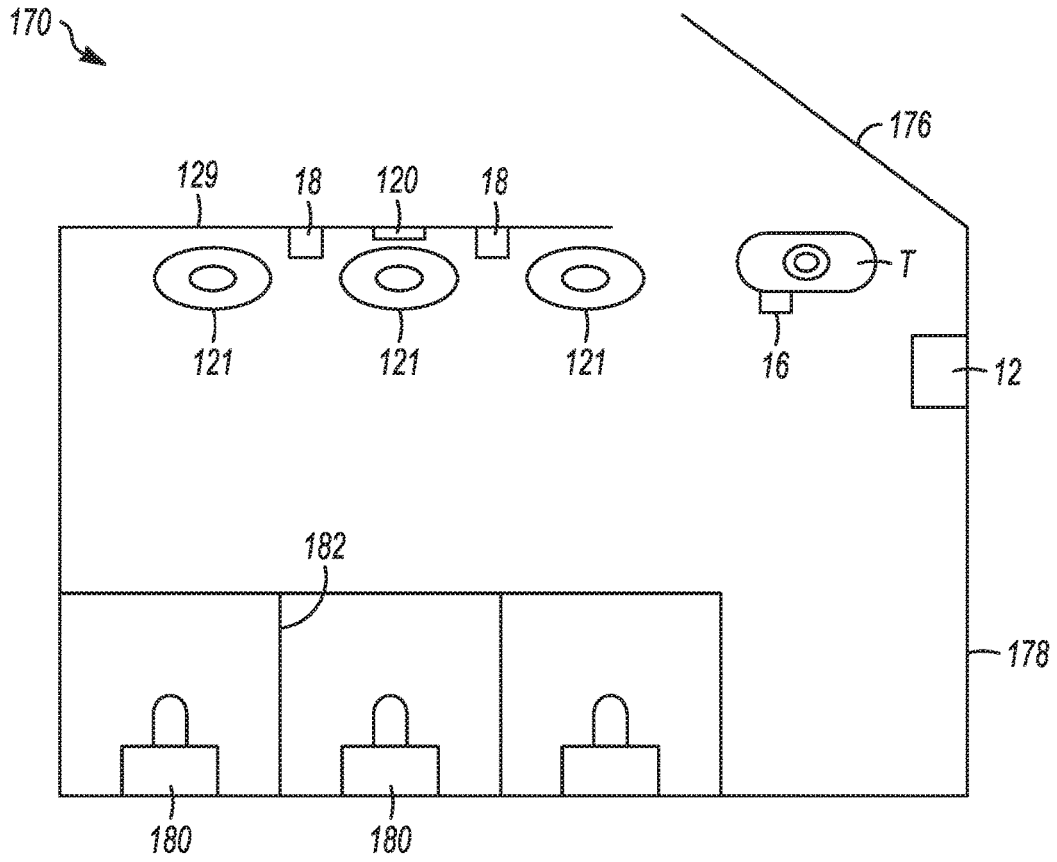
FIG. 4 is a schematic room diagram including a second embodiment of the system as described herein.

To better understand the method and device disclosed herein attention is directed to schematic diagrams depicted in FIGS. 3 and 4. FIG. 3A depicts a medical examination room or hospital room 70 configured with an embodiment of the hand sanitation and monitoring system 10 as disclosed herein. The examination room or hospital room 70 includes at least one patient treatment table or bed 72 and a handwashing sink or station 74. The entryway sensor array 12 is mounted proximate to the doorway 76 of treatment or patient room 70. The entryway sensor array 12 may include a suitable on board power source such as a battery solar cell or the like. It is also contemplated that the entryway sensor array 12 can be connected to an external source of power as required (not shown). Entryway sensor array 12 is be positioned such that the presence, movement and identity of a target worker T entering the room 70 can be ascertained. In the embodiment depicted, the entryway sensor array 12 is located on a wall 78 proximate to the doorway 76. It is also contemplated that the entry way sensor array 12 may be positioned on the associated door 76, on the lintel, or other suitable location. The entryway sensor array 12 can be configured to emit a suitable RFID signal or read one emitted by an RFID device 16 or other suitable identifying device integrated into the worker identity tag worn by the targeted worker T depicted as entering the room. The entryway sensor array can include a suitable transmission device (not shown) that is configured to transmit pertinent data to the controller 20.

A signal indicting detection of a target worker T as derived from detection of the ID tag 14 of the target worker T as well as any associated worker identity information can be transmitted by the entryway sensor 12 to a hand hygiene material dispenser 18 that is located proximate to the handwashing station or sink 74. The signal, along with any associated ID information, can be received by receiver 54 located in the controller unit 20 connected to on the hand hygiene material dispenser 18.

In various heath care settings standard protocol requires the worker to wash his or her hands prior to making contact with the patient located in bed 72. Thus the worker T would initially approach the sink 74 and associated dispenser 18 generally along path A. After the hand hygiene regimen has been followed, the worker would approach the patient in bed 72 as along pathway B.

The signal emanating from entryway sensor array 12 can trigger a timer mechanism that is contained in the controller unit 20 of hand hygiene dispenser 18. Once a predetermined time has elapsed, the controller 20 can actuate an audible and/or visible warning alarm 62 designed to remind the target worker T that hand hygiene operations must be promptly attended to. The warning alarm 62 can be a type that directs the attention of the target worker T attention to the hand hygiene dispenser unit 18. This can be a light, a flashing light, an audible alarm or a combination of the same. It is within the purview of this disclosure that the intensity of the alarm can vary with elapsed time to increase in intensity as time continues. In certain embodiments, activation of the alarm 62 can commence after a predetermined interval; typically, an interval sufficient to permit the average target worker T to reach the dispenser unit 18. The alarm 62 can commence at the expiration of the predetermined interval and can increase in intensity as time elapses, if desired or required.

Once the target worker T reaches the hand hygiene dispenser 18, the worker ID badge 16 can be detected when the target worker T is proximate to the hand hygiene dispenser 18. Activation of the dispenser nozzle 26 or trigger 27 together with detection of the worker ID badge 16 can produce a command signal to discontinue alarm activation and to record a compliance with hand washing protocol.

If the target worker T ignores the alarm 62 and fails to activate the nozzle 26 and trigger 27 of hand hygiene dispenser 18, the hand sanitation and monitoring system 10 records the event as non-compliance and transmits the information to the remote detection device 28, 29. In certain embodiments, the non-compliance signal will be delayed until the exit target worker T from the monitored room 70 is detected by the sensor array 12.

It is also considered within the purview of the present disclosure that the hand sanitation and monitoring system 10 can be configured to include protocols that distinguish between classes of target workers T. This distinction can be derived from the identity of can include readable data resident on the worker ID badge 14 regarding the classification of the specific target worker T. By way of example, in a health care setting, target workers, such as nurses, aides orderlies and the like whose job description required direct patient contact would be expected to engage in defined hand hygiene activities. Entry of a member of this class of workers would trigger the hand hygiene protocol previously discussed. Certain workers, such as dietary aides, social worker and the like, may be required to enter the room 70 briefly and without patient contact. These workers can be classified differently such that detection by the sensor array 12 and identification by controller 20 does not trigger the monitoring protocol.

An alternate embodiment of the system is depicted in FIG. 3B that includes an inner boundary sensor 80. Inner boundary sensor 80 can be positioned at a suitable location in the interior of a patient room and can be configured to detect transit toward the sensor 80 and past a boundary 82 defined thereby. The system can be configured to ascertain that an target individual who is otherwise exempted from the hand washing requirement has approached or passed through a defined inner boundary proximate to bed 72 and, in so doing, is now required to conduct handwashing operations which if not registered will trigger the alarm protocol as defined previously.

An alternate embodiment and application are depicted in FIG. 4. FIG. 4 depicts a rest room 170 typically found in a food service establishment, such as a restaurant for food processing plant. Food service installations typically require that all workers wash their hands after being in the rest room. Smaller establishments may require that workers and patrons use the same facilities.

The rest room 170 is configured with an embodiment of the hand sanitation and monitoring system 10 as disclosed herein. The rest room 170 as depicted in FIG. 4 includes at least one toilet 180 present in stall 182 as well as a plurality of sinks 121. The entryway sensor array 12 is mounted proximate to the doorway 176 of rest room 170. The entryway sensor array 12 may include a suitable on board power source, such as a battery solar cell or the like. It is also contemplated that the entryway sensor array 12 can be connected to an external source of power as required (not shown). Entryway sensor array 12 is positioned such that the presence, movement, and identity of a target worker T entering the room 170 can be ascertained. In the embodiment depicted, the entryway sensor array 12 is located on a wall 178 proximate to the doorway 176. It is also contemplated that the entry way sensor array 12 may be positioned on the associated door 176, on the lintel, or other suitable location. The entryway sensor array 12 can be configured to emit a suitable RFID signal or read one emitted by an RFID device 16 integrated into the worker identity tag worn by the targeted worker T depicted as entering the room. The entryway sensor array 12 can include a suitable transmission device (not shown) that is configured to transmit pertinent data to the controller 20.

The rest room 170 can include at least one hand hygiene unit 18 that is associated with and proximate to one or more sink(s) 121. In the embodiment depicted in FIG. 4, the rest room 170 has three sinks 121 and two hand hygiene units 18 that are mounted on wall 179 proximate to the sinks 121. In certain embodiments, each hand hygiene unit 18 can include a suitable proximity sensor 24 that is integrated in the hand hygiene dispenser unit 18. The proximity sensor 24 is in electronic communication with either the controller 20 that is integrated with the chamber 17 of an individual hand hygiene unit 18 as illustrated in FIG. 1. Alternately, a plurality of hand hygiene units can be ganged and electronically connected to a central controller 120.

Depending on the location of the controller 120 relative the plurality of hand hygiene units 18, the proximity sensor 24 can be located on the controller 120. Alternately, the individual hand hygiene units 18 can each be configured with a proximity sensor 24. As discussed previously, the proximity sensor 24 can be configured to identify the ID device 16 associated with the target worker T and convey data to the CPU 52 located in the controller. The CPU 52 can query the collected data to determine whether the ID device 16 that is perceived by the proximity sensor has been recently identified by the perimeter sensor array 12.

The signal emanating from entryway sensor array 12 can trigger a timer mechanism that is contained in the controller unit 20 of hand hygiene dispenser 18. Once a predetermined time has elapsed, the controller 20 can actuate an audible and/or visible warning alarm 62 designed to remind the target worker T that hand hygiene operations must be promptly attended to. The warning alarm 62 can be a type that directs the attention of the target worker T attention to the hand hygiene dispenser unit 18. This can be a light, a flashing light, an audible alarm, or a combination of the same. It is within the purview of this disclosure that the intensity of the alarm can vary with elapsed time, for example to increase in intensity as time continues. In certain embodiments, activation of the alarm 62 can commence after a predetermined interval; typically, an interval sufficient to permit the average target worker T to use the bath room facilities and to reach the dispenser unit 18. The alarm 62 can commence at the expiration of the predetermined interval and can increase in intensity as time elapses, if desired or required.

Once the target worker T reaches the hand hygiene dispenser 18, the worker ID badge 16 can be detected while the target worker T is proximate to the hand hygiene dispenser 18. This information can be conveyed to the CPU resident in the controller 20. That act followed at a close interval with the activation of the dispenser nozzle 26 or trigger 27 are construed as compliance and cause the CPU to construe that hand washing has been accomplished. This event, together with detection of the worker ID badge 16 by proximity sensor can result in production of a command signal to discontinue alarm activation and to record a compliance with hand washing protocol.

If the target worker T ignores the alarm 62 and fails to activate the nozzle 26 and trigger 27 of hand hygiene dispenser 18, the hand sanitation and monitoring system 10 can record the event as non-compliance and transmits the information to the remote detection device 28, 29. In certain embodiments, the non-compliance signal will be delayed until the departure of the target worker T from the monitored room 170 is detected by the sensor array 12. If the target worker T departs from the rest room 170 without triggering the hand hygiene device 18 and being detected proximate to the dispenser 18, in addition to preparing a report on non-compliance as was discussed in conjunction with the embodiment in FIG. 3, the controller can issue a command to engage a notification alarm located on the externally position device such as cell phone 28. It is also within the purview of this disclosure to trigger and audible and/or visible alarm that is located in the food preparation and handling area.

Figure 5:
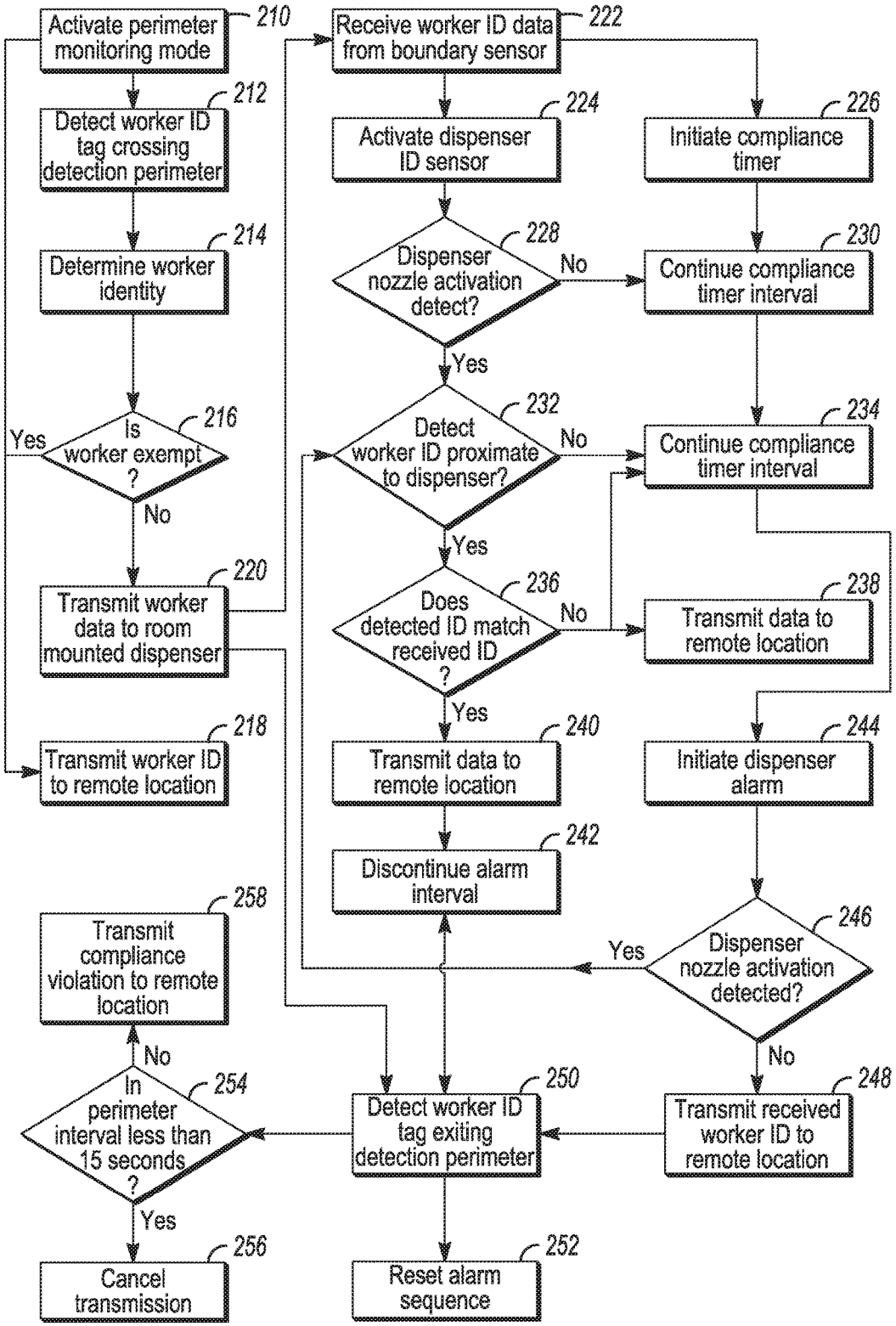
FIG. 5 is a process diagram for an embodiment of the process implemented in the schematic room of FIGS. 3A and 3 B.

In order to further discuss the process resident in the hand sanitation and monitoring system 10 that is implemented in the embodiment depicted in association with FIG. 3, attention is directed to the process diagram in FIG. 5. As outlined in FIG. 5, during routine operation, the hand sanitation and monitoring system 10 as disclosed herein engages in active perimeter monitoring as at reference number 210. This can be accomplished by reading RFID chips present in worker ID badges that cross the defined perimeter as at reference numeral 212*a*. In situations where no activity is detected in a defined interval as at reference numeral 212*c*, that negative data can be transmitted as a message to the remote location as at reference numeral 216*d*. The defined interval can be preset by the health care institution. Where desired or required, it can be can be derived from health care industry norms for interaction between patient and health care personnel in a given care level situation. It is also contemplated that the level of interaction may vary given the time of day; with fewer more regular entrances occurring during night time hours. By way of a non-limiting example, a no-activity report may be generated on the expiration of fifteen minute intervals during evening hours in a standard care patient room and every 7 minutes during day time hours in that same room. A no-activity report may be generated after an interval of five minutes in an intensive care unit room.

It is contemplated that a certain number of consecutive no activity reports will generate a system inquiry command from the remote location to the hand sanitation and monitoring system 10 to assess performance.

Once a target worker T is identified by the hand sanitation and monitoring system 10, upon crossing the perimeter as at reference numeral 212. The identity of the target worker T is the determined as at reference number 214. The identity determination can be a simple class identification check to determine whether the worker is a patient care nurse, dietician worker, maintenance worker, or the like. In certain classification protocol systems, it is contemplated that the necessary classification data can be resident on the chip present in badge 14. Alternately, personal identification information can be transmitted to the remote location for assessment and classification.

Figure 6A:
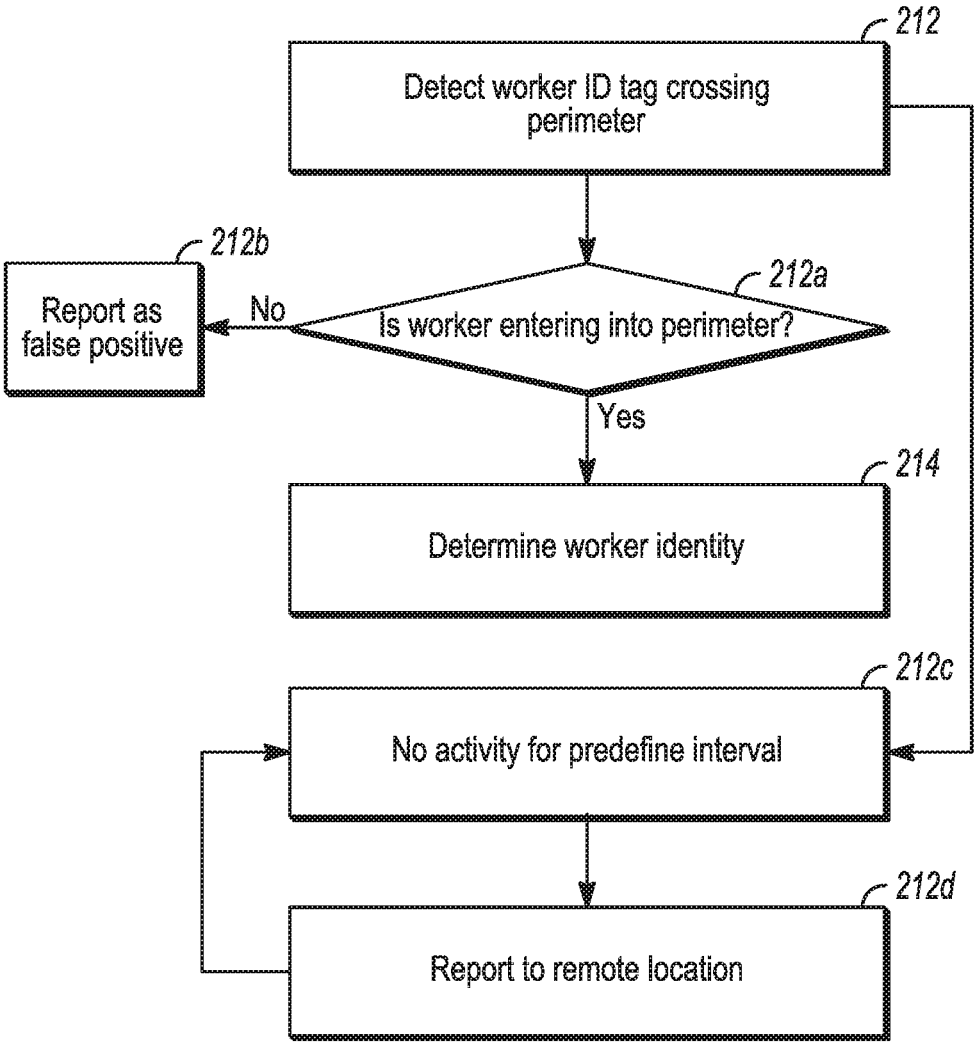
FIG. 6A is an embodiment of a first subroutine employed in the process outlined in FIG. 5.
Figure 6B:
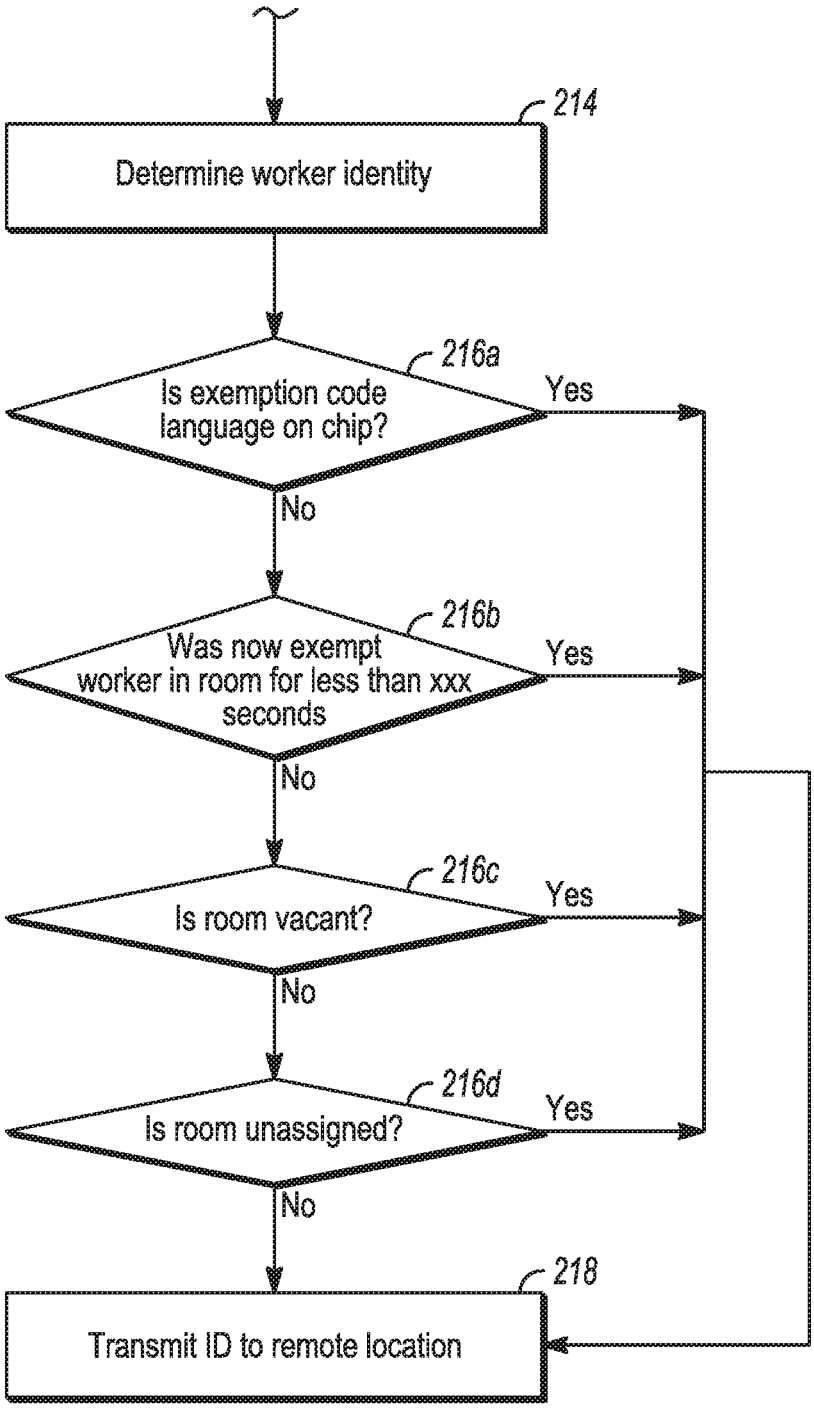
FIG. 6B is an embodiment of a second subroutine employed in the process outlined in FIG. 5.

One routine for determining worker exemption for the hand sanitation compliance method disclosed herein is presented in FIG. 6B. Once a target worker is identified as crossing the perimeter threshold, the target worker's identity can be determined for purposes of assessment for the hand washing compliance protocol as disclosed. This protocol can include a query to determine whether tan exemption code is present on the chip 16 embedded in the worker ID badge as at reference numeral 216*a*. If the worker is determined to be exempt, this development in transmitted to the remote location as at reference numeral 218. Where desired or require, this development can be transmitted with a time stamp and the worker identifier information for future macro analysis.

If the target worker is non-exempt from the mandated hand washing protocol, the on board system timer can ascertain whether the non-exempt worker was present in the room for less than a predetermined number of seconds as at reference numeral 216*b*. This can be determined by a number of different analytics. In one non-limiting example the sensor array 12 determines worker departure within a predetermined number of seconds, typically less time than it would take the worker to cross to the patient bed 72. In which case, the event can be reported to the remote location 218 and the alarm system on the dispenser 18 will not be activated.

Other exemption events may occur based on room status for example if the associated room is considered vacant (i.e., the patient has been temporarily removed from the room for a treatment, procedure of the like) as at reference numeral 216*c* or the room is currently unassigned (e.g., the patient has been released from the hospital, transferred to another room, etc) as at reference numeral 216*d*. It is contemplated that where hand washing system exemptions are room specific, the remote location data base associated with the hand sanitation and monitoring system 10 can be interfaced with suitable hospital systems to update such room status.

In the process as outlined above, if the target worker T is exempt, the process proceeds with step of transmitting material pertaining to the associated events to the remote location as at reference numeral 218. If the target worked T is not exempt, then the process proceeds as outlined in FIG. 5.

Once a target worker is determined to be non-exempt from the workplace mandated hand washing protocol, the worker ID data that was read by the sensor array 12 located at the boundary or perimeter of room R is transmitted to the controller 20 associated with hand washing dispenser 18 as at reference numeral 220 and received in the controller from the sensor array at reference numeral 222.

Reception of the targeted worker ID data at reference numeral 22 triggers potentially multiple activities within the controller 20. As depicted in the embodiment in FIG. 5, the hand hygiene dispenser sensor 24 is activated as to reference numeral 224 and the compliance timer present in the controller 20 is also initiated as at reference numeral 226.

Activation of the dispenser nozzle 26 and/or trigger mechanism 27 associated with the dispenser 18 is detected by controller 20 as at reference numeral 228. If no activation is detected, the compliance timer interval is continued as at reference numeral 230. If dispenser nozzle activation or activation of the trigger mechanism 27 is detected, the process proceeds to reference numeral 232 where the activated sensor 24 detects the target worker ID when the target worker T is in the region immediately proximate to the hand hygiene dispenser 18. Detection of the target worker ID proximate to the hand hygiene dispenser 18 can proceed by various modalities. Typically, the sensor 24 can function as a and RFID device that can read information encoded in the corresponding RFID chip 16 embedded in the ID badge 14.

Figure 6C:
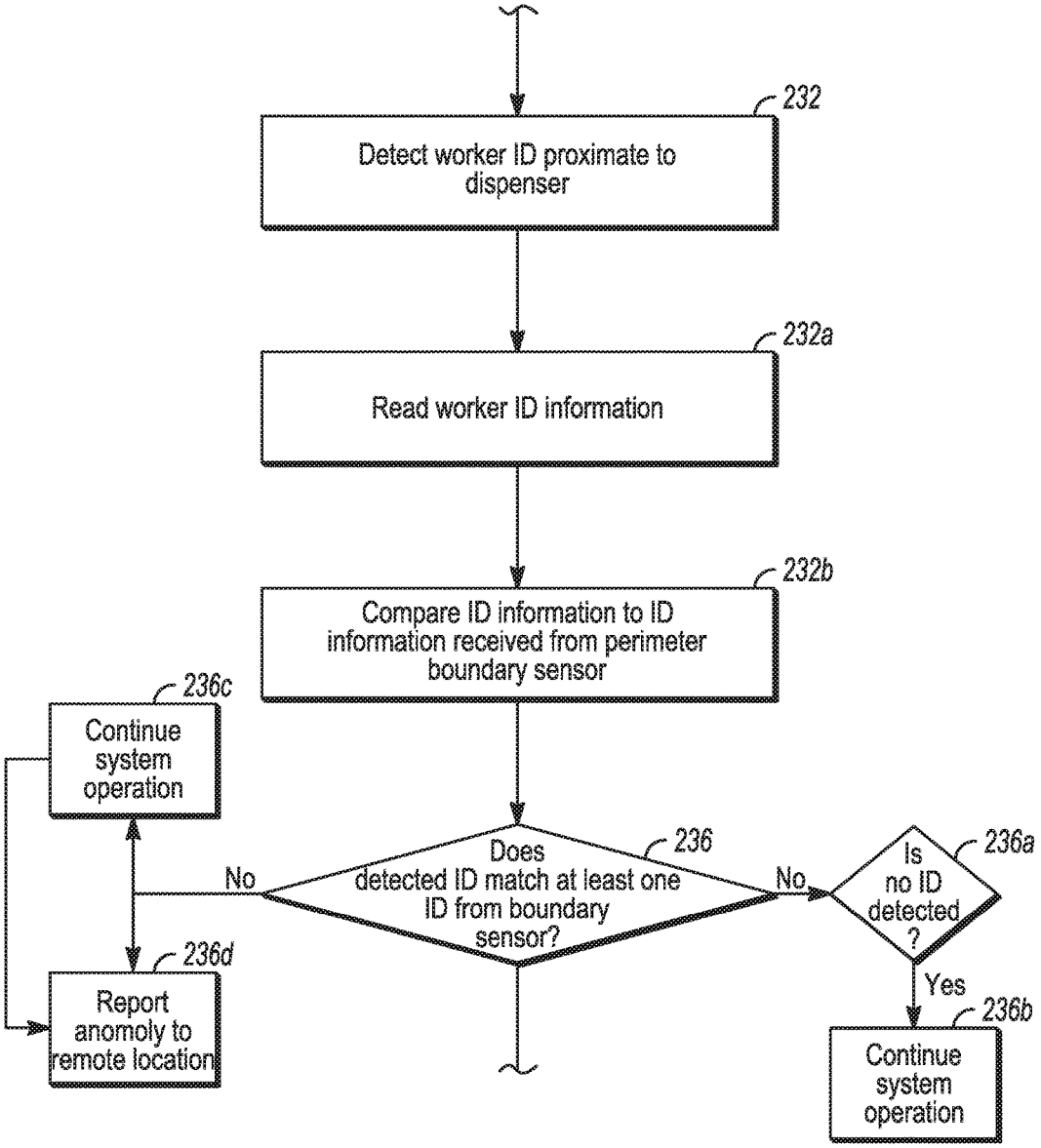
FIG. 6C is an embodiment of a third subroutine employed in the process outlined in FIG. 5.
Figure 6D:
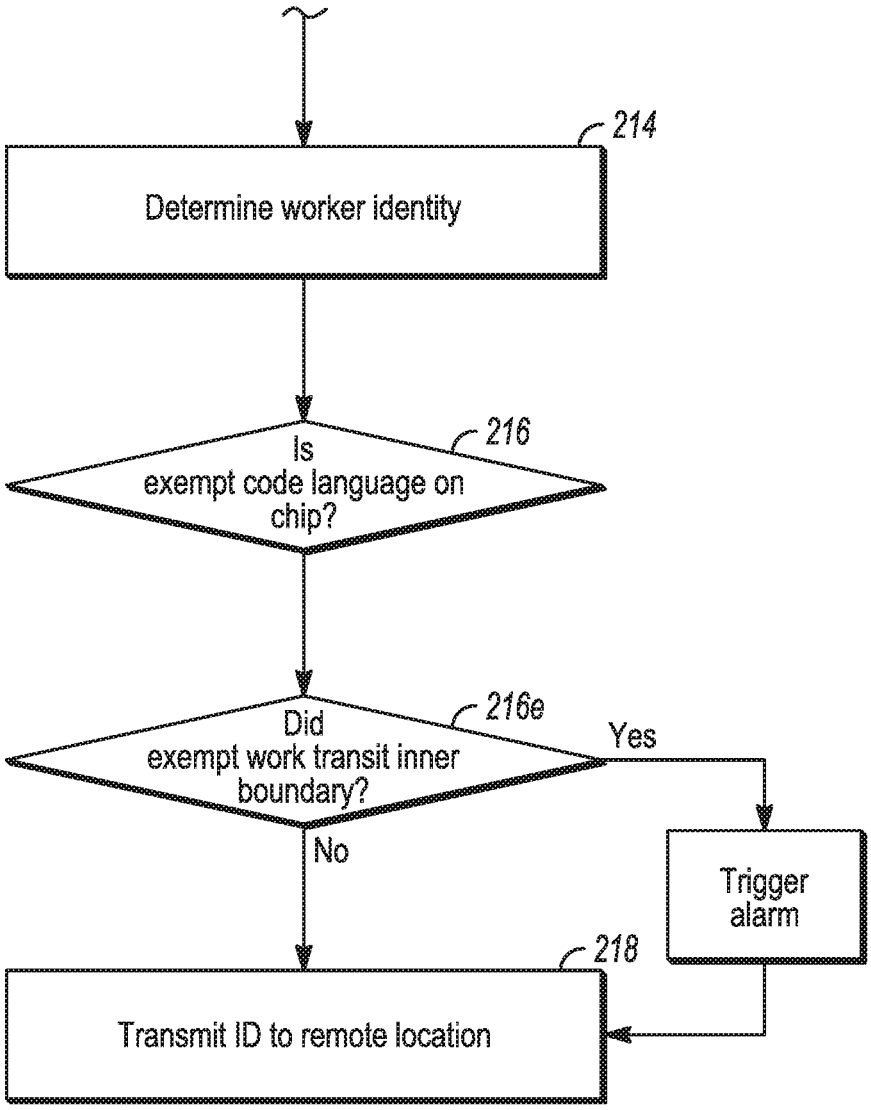
FIG. 6D is an embodiment of a fourth subroutine employed in the process in FIG. 5.
Figure 7:
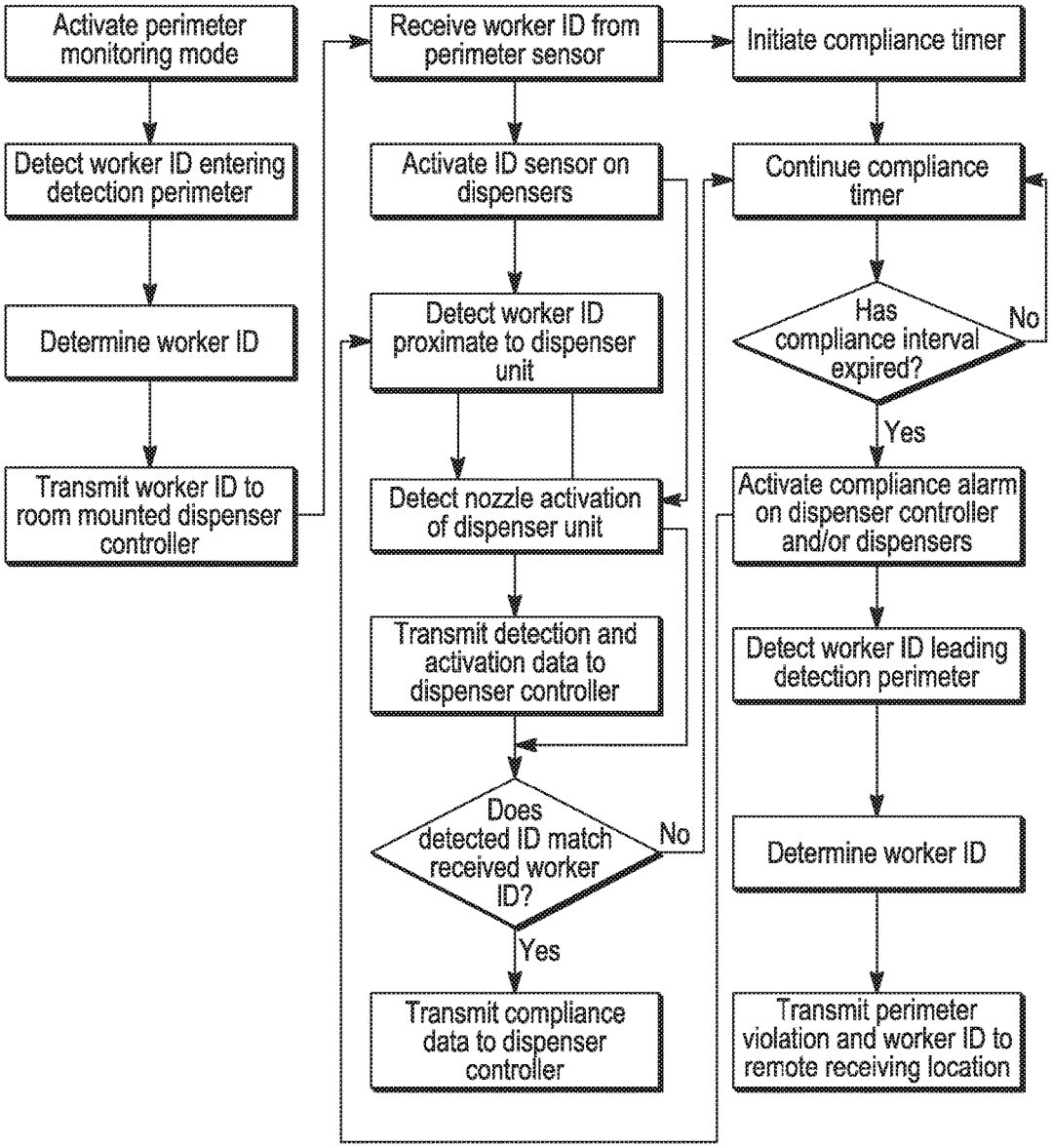
FIG. 7 is a process diagram for an embodiment of the process implemented in the schematic room of FIG. 4.
Figure 8:
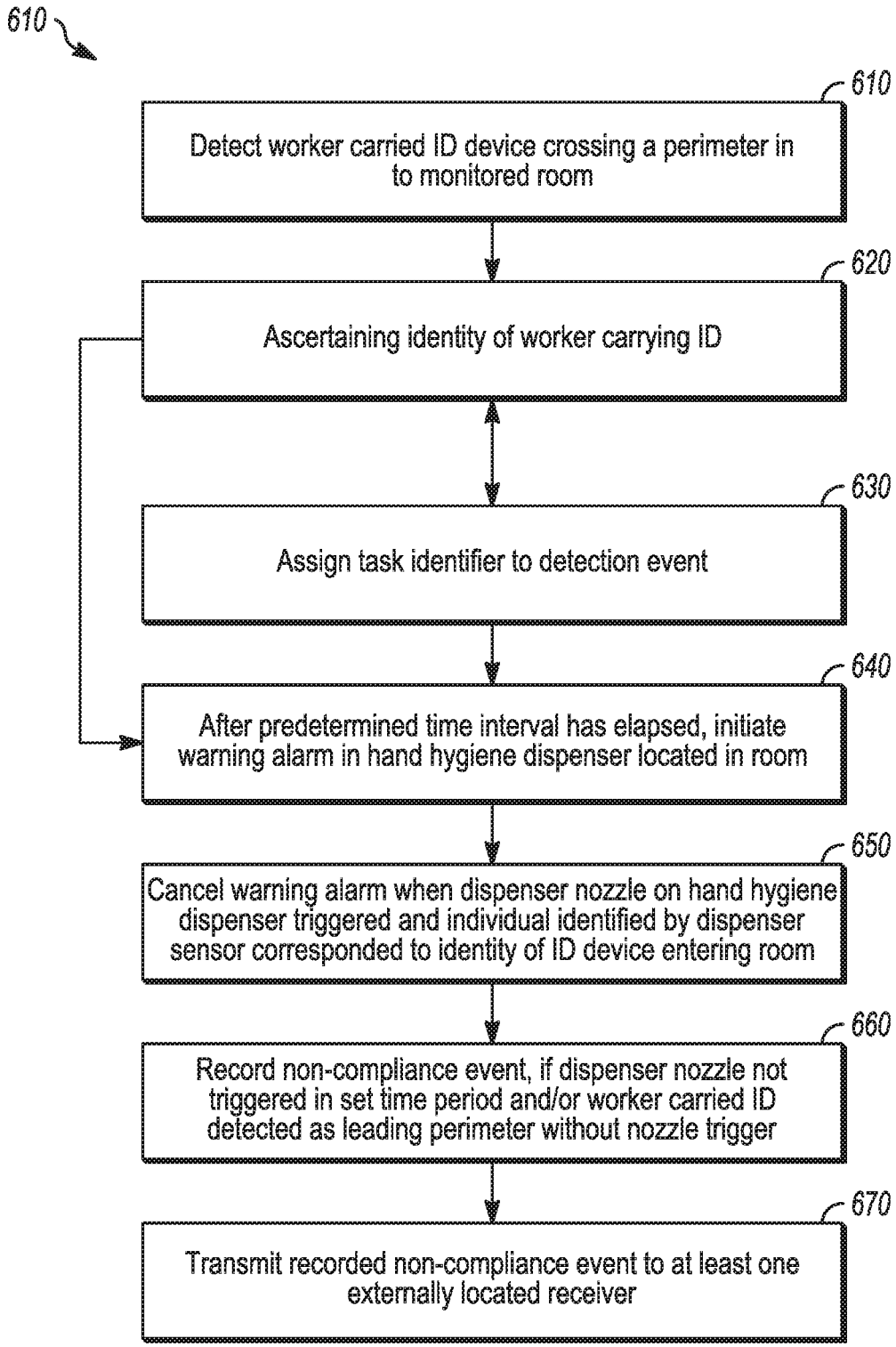
FIG. 8 is a flow chart of an embodiment of a method for encouraging employee compliance as disclosed herein.

In the embodiment as outlined in FIG. 5, the target worker ID is read by the activated hand hygiene sensor 24 as at reference numeral 232*a*. The read ID information derived from the sensor 24 is compared with the received ID information derived from the boundary sensor array 12 as at reference numeral 232*b* (see FIG. 6C). If no ID is detected at reference numeral 232 or if the ID does not match the received ID as at reference numeral 236, compliance timer operation will continue as at reference numeral 234. Where desired or required, ID mismatches are reported to remote location as at reference numeral 238. ID mismatches can be stored for further analysis and potential resolution. Operation of the monitoring system 10 can continue in spite of ID mismatch as at reference numeral 236*b* with the anomalous data being handled off line for resolution.

It is also considered with in the purview of this disclosure to provide for an operation of sensor 24 and identification of the proximate ID 16 immediately prior to or contemporaneous with the activation of the trigger 27 or dispenser nozzle 26.

Establishing a match between ID data transmitted by sensor 12 and ID data read by the sensor 24 together with indication that the trigger 27 or nozzle 26 have been activated will result in a transmission of both ID specific and global compliance data to the remote location as at reference numeral 240 and issuance of a command that results in discontinuation of the alarm interval as at reference numeral 242.

In the alternative, the expiration of the of the compliance timer interval will produce a command to initiate the dispenser alarm as at reference numeral 244. The dispenser alarm can be any event that will draw attention to the dispenser 18 to remind the target worker T of the need to implement the employer mandates handwashing protocol. The compliance timer interval will typically be an interval less than the time required for the target worker T to cross room 170 and contact the patient present in bed 172.

The alarm command can result in alarm actuation manifested as flashing lights, audible chimes, or a combination of both in certain embodiments. In the certain applications, it is contemplated that the intensity of the alarm will increase as the time of alarm activity continues. Alarm activity is discontinued upon activation of the dispenser nozzle 26 and/or trigger mechanism 27 as at reference numeral together with the detection of the target worker ID proximate to the dispenser 18 as detected by sensor 24. In the event that the detected ID does not match the ID detected by sensor array 12, the mismatched data can be transmitted to the remoted location for resolution.

In order to minimize patient disturbance, the alarm actuation interval can be timed and alarm operation can be discontinued after a defined interval or when the target worker T exits the room R as determined by sensor array 12 as at reference numeral. Worker exit can also trigger and alarm sequence rest as at reference numeral 252.

In certain embodiments, exit of the target worker T can also result in cancellation of operations as when the target worker T is within the perimeter such as room R for less than a defined interval, for example, 15 seconds as at reference numerals 254, 256. In the embodiment depicted in FIG. 5, residence in the room R for an interval greater than 15 seconds is considered a de facto compliance violation and is reports as such to the remote location as at reference numeral 258.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A hand hygiene system comprising:

at least one dispenser unit having an outer housing defining an interior chamber and a dispenser nozzle, the interior chamber containing a volume of a hand soap or sanitizing agent and the dispenser nozzle configured to release a measured amount of the hand soap or sanitizing agent upon a triggering event, the at least one dispenser unit is associated with at least one objective unit located within a defined perimeter;

a plurality of worker-specific RFID devices, wherein at least one worker carries one of the plurality of worker-specific RFID devices;

at least one control unit mounted to the dispenser unit, the control unit in electronic communication with the dispenser nozzle, the control unit having at least one RFID identity sensor, the RFID identity sensor having a mechanism for determining and identifying a worker located proximate to the dispenser unit by detecting the presence of at least one of the plurality of worker-specific RFID devices, at least one alarm indicator and at least one transceiver facilitating two-way communication with at least one device remote to the hand hygiene system; and at least one first proximity sensor in electronic communication with the control unit, the first proximity sensor located a spaced distance from the at least one dispenser, wherein the first proximity sensor positioned proximate to an entry and egress portal, wherein the at least one dispenser unit is associated with at least one objective unit and wherein the objective unit is located within the defined perimeter and wherein the entry and egress port is located on the defined perimeter; at least one second proximity sensor in electronic communication with the control unit, the at least one second proximity sensor located a spaced distance from the at least one dispenser and from the first proximity sensor, the second proximity sensor positioned at a location between the entry and egress portal and the objective unit, the second proximity sensor defining an inner boundary located between the portal and the objective unit such that the defined perimeter includes a first region and a second region, the at least one dispenser unit and the entry and egress portal located in the first region and the objective unit located in the second region, the objective unit being distal to the portal, the at least one second proximity sensor configured detect forward movement of a worker from the first region to the second region toward the objective unit;

wherein the alarm indicator on the dispenser unit includes an audible alarm, a visible alarm, or a combination of an audible alarm and a visible alarm, and wherein the dispenser unit includes at least one alarm shut off mechanism, the alarm shut off mechanism operatively connected to the dispenser nozzle; wherein the first proximity sensor is configured to identify movement of at least one worker in a coordinate plane having an X-Y axis relative to the entry and egress portal, wherein the X axis traverses the entry and egress portal and the Y axis is planar to the egress and entry portal, the first proximity sensor located proximate to the entry and egress portal, and wherein the first proximity sensor is configured to identify and characterized movement in the X-axis plane from movement of at least one the worker in the Y-axis plane.

2. The hand hygiene system of claim 1, further comprising a central processing unit, the central processing unit associated with one of the first proximity sensor, the second proximity sensor or the dispenser unit, and at least one remote transmission device mounted on either the proximity sensor or the dispenser unit, the transmission device in communication with at least one remote receiver unit.

3. The hand hygiene system of claim 2, wherein the worker specific RFID devices can be indexed by sensors positioned on the at least one first proximity sensor, the dispenser unit, and the at least one second proximity sensor wherein at least a portion of the worker-specific RFID devices includes at least one worker class indicator.

4. The hand hygiene system of claim 3, further comprising at least one programmed controller associated with the at least one control unit, the programmed controller having programming logic that compares an activation time of triggering of the at least one first proximity sensor located a spaced distance from the at least one dispenser with a programmed transit time to assess dispenser activation and classification of at least one worker specific RFID device after detection by the RFID identity sensor of the control unit.

5. The hand hygiene system of claim 4, further comprising at least one activation detection mechanism associated with the dispenser nozzle, the activation detection mechanism in operative connection with the programmed controller.

6. The hand hygiene system of claim 1, wherein the objective unit is one of a patient bed, a patient wrist band, a medical device and wherein the objective unit includes at least one identity device detectable by the at least one control unit mounted to the at least one dispenser unit.

7. The hand hygiene system of claim 3, wherein the first proximity sensor is further configured to identify a worker transiting the X-axis defined by the first proximity sensor by worker function classification data present on the worker-specific RFID device, wherein the worker function classification data present on the worker-specific RFID device includes either a first worker classification or a second worker classification, and wherein the first worker classification triggers a preprogrammed activation time and the second worker classification that does not trigger the preprogrammed activation time.

8. A method for promoting and monitoring hand hygiene in a defined space comprising the steps of:

providing at least one interior room having an entry and egress portal defining a room boundary with at least one first proximity sensor positioned proximate to the entry and egress portal, wherein the first proximity sensor is configured to detect a presence and an identity of at least one worker-carried RFID device as the RFID device crosses the room boundary associated with the at least one interior room; providing the at least one first proximity sensor and at least one second proximity sensor both in electronic communication with a control unit and located a spaced distance from at least one dispenser unit the first proximity sensor positioned at a location between an entry and egress portal and an objective unit the second proximity sensor located between the portal and the objective unit and defining an interior boundary such that the room boundary has a first region and a second region, and the entry and egress portal is located in the first region and the objective unit is located in the second region distal to the entry and egress portal, the second proximity sensor configured to detect forward movement of a worker from the first region to the second region toward the objective unit;

providing at least one dispenser unit configured with an interior chamber, the interior chamber-containing one of a hand soap or sanitizer material, the interior chamber accessible by a dispenser nozzle, the dispenser unit located in the first region of the room at a spaced distance from the first proximity sensor, the dispenser unit having at least one control unit configured to electronically communicate with the at least one first proximity sensor and the at least one second proximity sensor within the room wherein the second proximity sensor is configured to detect the presence of at least one identified worker carried RFID device at a location proximate thereto, at least one transceiver facilitating two-way communication with at least one device remote to room boundary, a signal detector and at least one alarm indicator;

generating at least one signal in the at least one first proximity sensor, the signal directed by the transceiver in the dispenser unit, wherein the generating step is triggered by detection of at least one worker-carried RFID device crossing the room boundary;

initiating a wait sequence interval wherein, upon receipt of the signal from the transceiver, the wait sequence terminates, termination occurring with receipt of an alarm signal from the dispenser or a predetermined interval, whichever is shorter;

when the dispenser nozzle is activated, determining the worker-carried RFID device proximate to the dispenser unit at the time of actuation; and generating an alarm upon receipt of the alarm signal, the alarm having at least one physically detectable component, the physically detectable component being at least one of an audible sound, a visible light, or signal; and differentiating at least two classes worker-carried RFID devices wherein at least one class of worker-carried RFID devices is an exempted class and is configured to be detected by the first proximity sensor without triggering the signal generating step.

9. The method of claim 8, wherein the second proximity sensor defines at least one inner boundary located between the entry and egress portal and the objective unit, the second proximity sensor configured to detect forward movement of a worker carrying at least one of the exempted class worker-carried RFID devices into the room toward the objective unit, and wherein the method further comprises the steps of:

detecting the exempted class worker-carried RFID device;

and calculating transit relative to the second proximity sensor, wherein transit over the inner boundary generates at least one signal in the second proximity sensor, the signal directed by the signal detector in the dispenser unit and generating at least one alarm activation signal.

* * * * *